US010792220B2

(12) United States Patent
Trower et al.

(10) Patent No.: US 10,792,220 B2
(45) **Date of Patent: *Oct. 6, 2020**

(54) MEDICATION DISPENSING SYSTEM

(71) Applicant: Accredo Health Group, Inc., Memphis, TN (US)

(72) Inventors: Kristin Trower, St. Louis, MO (US); Christina J. Thach, Webster Groves, MO (US); Clark Bitney, Manchester, MO (US)

(73) Assignee: Accredo Health Group, Inc., Memphis, TN (US)

( * ) Notice: Subject to any disclaimer, the term of this patent is extended or adjusted under 35 U.S.C. 154(b) by 41 days.

This patent is subject to a terminal disclaimer.

(21) Appl. No.: 16/244,716

(22) Filed: Jan. 10, 2019

(65) Prior Publication Data

US 2019/0151196 A1 May 23, 2019

Related U.S. Application Data

(63) Continuation of application No. 15/259,588, filed on Sep. 8, 2016, now Pat. No. 10,265,243.

(Continued)

(51) Int. Cl.

| | |
|---|---|
| ***A61J 1/03*** | (2006.01) |
| ***B65D 75/52*** | (2006.01) |
| ***B65D 75/30*** | (2006.01) |
| ***B65D 75/32*** | (2006.01) |

(Continued)

(52) U.S. Cl.

CPC ..... *A61J 1/03* (2013.01); *B65D 75/30* (2013.01); *B65D 75/327* (2013.01);

(Continued)

(58) Field of Classification Search

CPC ..... A61J 1/03; B65D 75/30; B65D 77/04; B65D 75/327; B65D 75/527; B65D 75/54;

(Continued)

(56) References Cited

U.S. PATENT DOCUMENTS 5,259,499 A 11/1993 Boettger
5,325,968 A * 7/1994 Sowden ..... A61J 1/035 206/532

(Continued)

FOREIGN PATENT DOCUMENTS

WO 2010/089091 A1 8/2010
WO 2013/160850 A1 10/2013

*Primary Examiner* — Rafael A Ortiz
(74) *Attorney, Agent, or Firm* — Stinson LLP

(57) ABSTRACT

Methods and systems for a drug supply with an associated dosing regimen are described. Sachets may to store at least one pharmaceutical drug. A dosing bag holds at least one sachet and stores a specific pharmaceutical dose. Dosing bag assemblies are formed from one or more than one dosing bag and can be connected together to form a package. A book may be formed to include a plurality of drug containing bags or bag assemblies, which may form pages in the booklet. The dosing bags may be removed from the pages to allow the patient to take the specific pharmaceutical dose with them. alternatively, the dosing bag may be opened in the booklet and the specific pharmaceutical dose may be taken.

24 Claims, 7 Drawing Sheets

Related U.S. Application Data

(60) Provisional application No. 62/215,251, filed on Sep. 8, 2015.

(51) Int. Cl.
*B65D 77/04* (2006.01)
*B65D 75/54* (2006.01)

(52) U.S. Cl.
CPC ..... *B65D 75/527* (2013.01); *B65D 75/54* (2013.01); *B65D 77/04* (2013.01)

(58) Field of Classification Search
CPC ..... B65D 69/00; B65D 71/00; B65D 75/325; B65D 75/5805
USPC ..... 206/232, 570, 225, 424, 528, 538, 539, 206/450, 459.5, 472
See application file for complete search history.

(56) References Cited

U.S. PATENT DOCUMENTS 6,082,544 A 7/2000 Romick
6,669,236 B1 * 12/2003 Hollwarth-Oberholz ..... A61J 1/035 206/534
6,708,826 B1 3/2004 Ginsberg
7,866,476 B2 1/2011 McGonagle et al.
7,926,850 B1 4/2011 Muncy
7,971,414 B1 7/2011 McGonagle
7,987,986 B2 8/2011 Leifeld
9,241,873 B2 1/2016 Upchurch et al.
2002/0159657 A1 10/2002 Delorme
2005/0150809 A1 7/2005 Pile
2005/0258065 A1 11/2005 Stroppolo
2006/0042990 A1 3/2006 Galuten
2006/0118436 A1 6/2006 Lapsker
2006/0219595 A1 10/2006 Peters
2007/0141199 A1 * 6/2007 Ishikawa ..... B65D 5/38 426/3
2008/0128450 A1 6/2008 O'Gorman et al.
2009/0139893 A1 6/2009 McGonagle et al.
2009/0230013 A1 * 9/2009 Born ..... A61J 7/0084 206/531
2009/0242451 A1 10/2009 Kessler
2013/0202226 A1 8/2013 Hartzfield

* cited by examiner

MEDICATION DISPENSING SYSTEM

CROSS-REFERENCE TO RELATED APPLICATIONS

This application is a continuation application of U.S. patent application Ser. No. 15/259,588 on Sep. 8, 2016; said application claims the benefit of U.S. Provisional Application No. 62/215,251, filed Sep. 8, 2015; the entire disclosures of which are incorporated herein by reference.

FIELD

The field relates to medication dispensing, and more particularly to packaging prescription drugs.

BACKGROUND

Medical progress has developed pharmaceutical drugs that treat a variety of different types of illnesses. Many people are prescribed a once or twice a day drug regimen for certain diseases and at least attempt to maintain compliance with such a regimen.

Some drug therapies require more complex drug regimes. While some drug therapies utilize over the counter or prescription drugs, other drugs have a more expensive or complex therapy often associated with specialty pharmaceutical drugs. So called specialty drugs may be used to treat a chronic or difficult health condition, like multiple sclerosis or rheumatoid arthritis. In these cases, which may include a bottle or multiple bottles with different dosing regimens, a patient must track and take their drugs as prescribed. Failure to comply with the dosing regimens for these conditions could result in hospitalization, a failure to be cured, an additional and/or exacerbation of an existing serious health condition, or death. Adherence to the dosing regimen may be more challenging when the drug dosing schedule is complex or when the patient is a child or has special needs. As a result, compliance with the drug regimen may drop with an associated non-optimal outcome for the patient. Moreover, in the cases of specialty drugs, additional reporting and monitoring may be required.

SUMMARY

A pharmaceutical packaging assembly may include a plurality of sachets each configured to store at least one pharmaceutical drug, at least one dosing bag each configured to hold at least one of the plurality of sachets, and a plurality of dosing bag assemblies. Each of the at least one dosing bag may be further configured to store a specific pharmaceutical dose. Each of the plurality of dosing bag assemblies may be configured to store at least one of the dosing bags. The plurality of dosing bag assemblies may be connected together to form a package. In an example embodiment, each dosing bag stores a specific pharmaceutical dose, e.g., organized by time of dosage.

In an example embodiment, the plurality of dosing bag assemblies may include a first dosing bag assembly that includes a first set of dosing bags positioned to open to a first side and a second dosing bag assembly that includes a second set of dosing bags positioned to open to a second side. The first dosing bag assembly and the second dosing bag assembly are joined at a center spine.

In an example embodiment, the center spine spaces the first set of dosing bags and the second set of dosing bags.

In an example embodiment, the plurality of dosing bag assemblies are joined at the center spine to form a book.

In an example embodiment, the book includes a front cover and a rear cover, which enclose the plurality of dosing bag assemblies. The front cover and the rear cover may be joined by a booklet spine.

In an example embodiment, the dosing bags are individually separable from adjacent dosing bags within one of the plurality of dosing bag assemblies.

In an example embodiment, the center spine is fixed to the booklet spine of the book to secure the plurality of dosing bag assemblies between the front cover and the rear cover.

In an example embodiment, the plurality of dosing bag assemblies is arranged in a sequential order.

In an example embodiment, the plurality of dosing bag assemblies each include a first bag of the plurality of dosing bags containing a first drug dosage for a first dosing time and a second bag of the plurality of dosing bags containing a second drug dosage for a second dosing time that is taken at a different time than the first dosing time.

In an example embodiment, the plurality of dosing bag assemblies each includes a unique identifier to individually identify a pharmaceutical dose.

In an example embodiment, at least one of the dosing bags in a same dosing bag assembly is separable from the other dosing bags in the same dosing bag assembly.

In an example embodiment, each dosing bag includes an indicium with at least one of a treatment day, a drug name, and dosage information.

In an example embodiment, each dosing bag includes a stub that remains with the package when the respective dosing bag is opened or removed from the package, and wherein the stub includes a stub indicia that includes treatment day information, treatment time, or both.

In an example embodiment, the dosing bag includes a body defining an interior for storing the at least one of the plurality of sachets, the interior being closed except for one sealable area, and the sealable area being remote from the stub.

In an example embodiment, the dosing bag includes a separation border between the body and the stub to allow the dosing bag to be removed from the stub and the package.

Another pharmaceutical packaging assembly is described herein and may include a plurality of sachets each configured to store at least one pharmaceutical drug, at least one dosing bag each configured to hold at least one of the plurality of sachets, and each of the at least one dosing bag is further configured to store a specific pharmaceutical dose for a specific treatment time, a plurality of dosing bag assemblies, each dosing bag assembly configured to store at least one dosing bag, each dosing bag assembly defining a center spine, and a book including a front cover, a rear cover, and a booklet spine joining the front cover and the rear cover. The booklet spine is connected to the center spine to form the book enclosing the at least one dosing bag. In an example embodiment, the at least one dosing bag assembly of the plurality of dosing bag assemblies includes a sealed opening that is openable to access the pharmaceutical within the dosing bag in the book.

In an example embodiment, wherein the at least one dosing bag may further include a first set of dosing bags and a second set of dosing bags positioned to open to a second side. The center spine spaces the first set of dosing bags and the second set of dosing bags such that the first set of dosing bags defines a first page in the book and the second set of dosing bags defines a second page in the book.

In an example embodiment, the plurality of dosing bag assemblies may be arranged in a sequential order.

In an example embodiment, the plurality of dosing bag assemblies each include a first bag of the plurality of dosing bags containing a first drug dosage for a first dosing time and a second bag of the plurality of dosing bags containing a second drug dosage for a second dosing time that is taken at a different time than the first dosing time.

DETAILED DESCRIPTION

Example methods and systems for medication packaging assembly are described. The medication packaging assembly provides for shipment and delivery of the drugs, e.g., specialty drugs, while further providing for dosing instructions. The medication packaging assembly may include a package to organize and systematically dispense drugs for a treatment regimen. The present medication packaging assembly allows those patients with complex drug treatment regimens to have a systematic delivery of their drugs. The present medication packaging assembly may increase compliance with the drug treatment regimen. In some drug treatment regimens there may be changes in the type of drug or a dosage amount at a certain time of day or a change over a longer time period, e.g., changing the drug dosage amount or drug type over the course of weeks or the regimen time period.

The present disclosure describes assemblies that organize drugs, pharmaceuticals, and placebos (if needed) over the course of the treatment. Individual containers may be prepared for different dosage times. The individual containers are stored in bags or boxes that represent a same treatment time over a longer time period, e.g., a time of day. The patient need only remove the individual container for that dosage time at the same day and time for each dose. The patient takes all of the contents in the container. The dose in each container may be the same as some of other containers but, in an example embodiment, a container may have different contents, e.g., different drugs or different dosages, than other containers.

Figure 1:
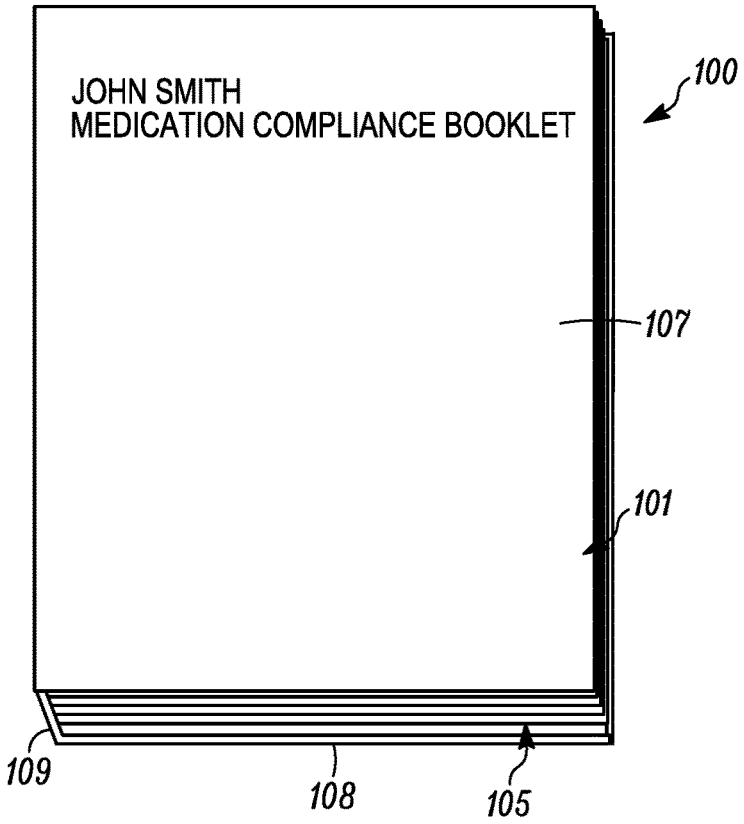
FIG. 1 is a view of a pharmaceutical packaging assembly, according to an example embodiment.

FIG. 1 is a view of a pharmaceutical packaging assembly 100, according to an example embodiment. The pharmaceutical packaging assembly 100 includes an outer cover 101 to at least partially enclose multiple dosing bag assemblies 105, which in turn may include one or multiple dosing bags 200 (FIG. 2) that may in turn hold one or multiple sachets 300 (FIG. 3). The dosing bag assemblies 105 may act as pages in the packaging assembly 100. The sachets 300 are an example embodiment of a mechanism that may be used to store the pharmaceutical drug. The pharmaceutical packaging assembly 100 is generally assigned to (and assembled for) a single patient. In general, the pharmaceutical packaging assembly 100 is assembled to increase compliance of the patient with the patient's drug regimen.

The outer cover 101 of the pharmaceutical packaging assembly 100 may be in the form of a book cover that has a front cover 107 joined to a back cover 108 by a booklet spine 109. The cover 101 may be a rigid or semi-rigid outer shell to at least partially protect the contents therein. The booklet spine 109 may also fix the dosing page assemblies 105 to the cover 101. In some embodiments, the dosing bag assemblies 105 may be bound to the booklet spine 109 by adhesives such as glue, paste, rubber cement, or the like. In some embodiments, the dosing bag assemblies 105 may be bound to the booklet spine 109 by other attachment mechanisms such as a spiral binding coil, a plastic binding spine, binder rings, and the like. For example, the booklet spine 109 may support binder rings that extend through apertures (e.g., as may be caused by an awl or hole punch) in the dosing bag assemblies 105. In an example embodiment, the binder rings are biased in a closed position that may be overcome with the application of force to the binder rings or operation of a lever. The binder rings may be locking such that once the rings are closed to fix the dosing bag assembly to the outer cover 101, the binder rings are not openable without damaging the rings. The booklet spine 109 may also allow for stitching though the booklet spine 109 and the dosing bag assemblies 105 to fix the dosing bag assemblies 105 to form the pharmaceutical packaging assembly 100. Stitching may also be used through the front cover 107, the dosing page assemblies 105, and/or the back cover 108. Other mechanical structures may be used to fix the dosing bag assemblies 105 in the pharmaceutical packaging assembly 100. The outer cover 101 may also include a press binder than presses the dosing bag assemblies 105, at a location separate from the drug storage areas, to fix the dosing bag assemblies 105 in the pharmaceutical packaging assembly 100. Pins that engage through holes within the dosing bag assemblies 105 may also be used to align the dosing bag assemblies 105 to fix the dosing bag assemblies 105 in the pharmaceutical packaging assembly 100.

At least one drug may be organized by the dosing regimen (e.g., as prescribed) within the pharmaceutical packaging assembly 100. In some embodiments, such organization may facilitate patient compliance with the dosing regimen of such drugs. In an example embodiment, the drugs contained within the pharmaceutical packaging assembly 100 may be different drugs and/or a same drug with different dosage amounts to comply with a particular dosing regimen. For example, each of the dosing page assemblies 105 may include the drugs for an entire day, with the individual dosing bags 200 for each time that a single drug or multiple drugs are to be taken during a day. In another example embodiment, the pharmaceutical packaging assembly 100 may be organized by multiple daily dosing on each dosing bag assembly. The dosing bag assembly may act as a page in the packaging assembly 100. The dosing bags 200 need not include the same drugs. Different drugs may be in at least one of the dosing bags. In the case where there are different doses for a same drug, then the dosing bags have the different doses for a same drug. Thus, the pharmaceutical packaging assembly 100 is organized in accordance the dosing regimen.

Figure 2A:
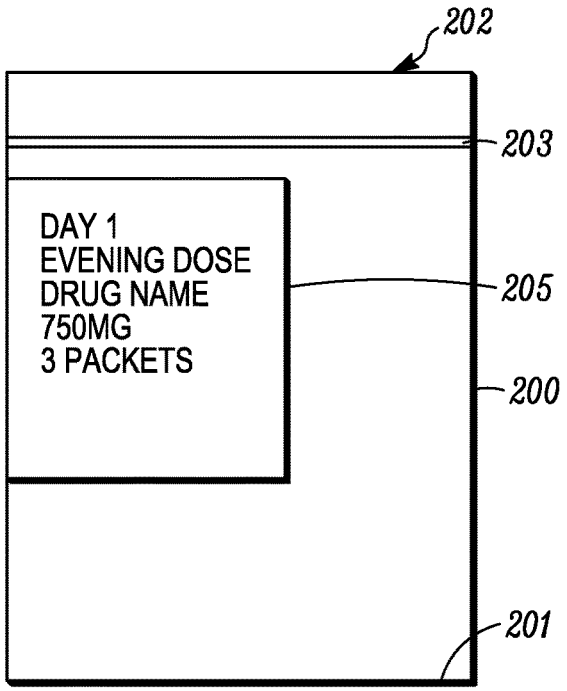
FIGS. 2A and 2B are views of a dosing bag that may be deployed within the pharmaceutical packaging assembly of FIG. 1, according to an example embodiment.
Figure 2B:
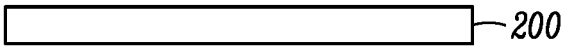
Figure 3A:
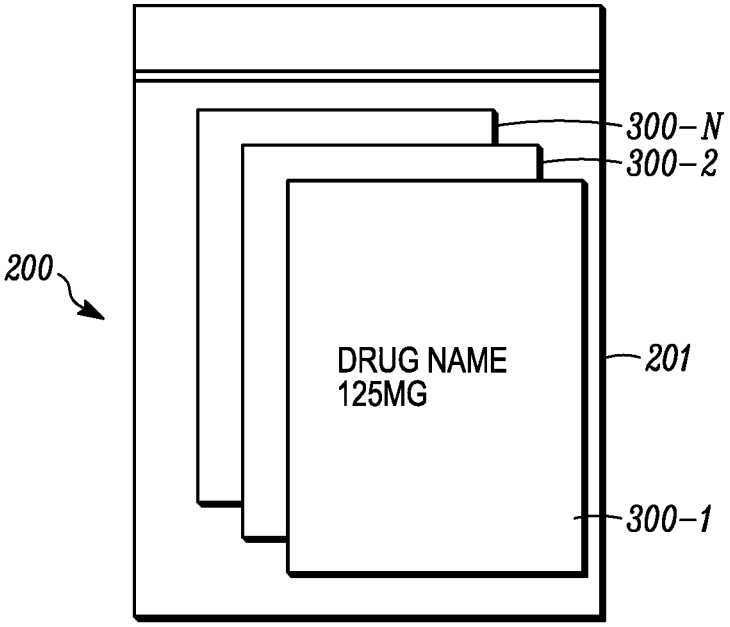
FIGS. 3A and 3B are views of a dosing bag loaded with sachets that may be deployed within the assembly of FIG. 1, according to an example embodiment.
Figure 3B:
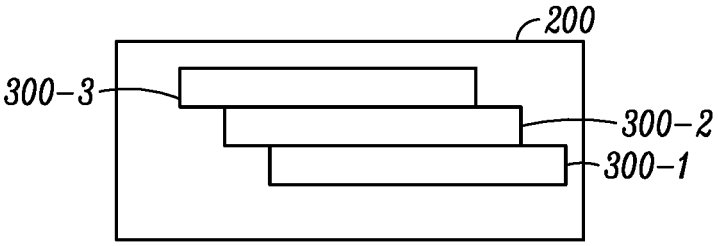

FIG. 2 is a view of a dosing bag 200 that includes a body 201 that forms a recess with an open top 202. The recess in the body 201 is enclosed by the body 201. The body 201 may be a polymer that is at least partially translucent so that the contents of the dosing bag 200 can be visually inspected. The body 201 may be a paper product, e.g., with a clear window therein such that the drugs may be visually see from outside the dosing bag 200. The recess is adapted to hold one or multiple drugs and/or one or multiple sachets containing a single drug or multiple drugs. A seal 203 is provided at the open top 202 to close the recess when a drug is being stored in the dosing bag 200. The seal 203 extends the entire length of the open top 202. The seal may be positioned along at least one entire edge of the dosing bag 200. In another example, the seal 203 and opening into the dosing bag 200 may be positioned in one planar side of the dosing bag 200. The seal 203 may be a one-time use seal such that when the seal 203 is opened the bag 200 may not be reclosed. The seal 203 may include perforations in the body of the dosing bag 200 that guide the mechanical separation of the body of the dosing bag. In another example embodiment, the seal 203 may be a resealable seal. The seal 203 may be a double track seal or a zipper type seal. The seal 203 may be formed directly in the body 201, e.g., by thermoforming. The seal 203 may also be a tape that extends over the open top 202. The part of the body 201 at the open top 202 may be folded down onto the body 201 and the seal may be an adhesive or tape that holds the open top onto the body 201. Other types of mechanisms to seal the dosing bag 202 may also be used.

An information area 205 is provided on the dosing bag 200. The information area 205 may include a sticker or label adhered to the outer surface of the bag body 201. For example, FIG. 2 reflects an example, where the text information within information area 205 states Day 1, Evening dose, Drug name, 750 mg, and 3 packets. Other similar terms can be used to reflect what is stored in a bag body 201, e.g., when the dosage amount changes, when the day changes, when the time for administration changes, when the drug type in the bag body changes, when the number of sachets changes, and the like. While the embodiment of FIG. 2 uses the term packets, it will be understood that the term sachets can be used in its place. The text information may also include patient information or medical care provider information. The text information may also include the number of pills that are stored in the bag body.

The information area 205 may be part of the dosing bag 200 that has a surface prepared to display information to be read by the patient on the dosing regimen associated with the pharmaceutical packaging assembly 100, a caregiver of such a patient, or otherwise (e.g., a parent, a spouse, or a prescriber of the patient). The bag body 201 may allow the information to be printed or laser marked or etched on the information area 205. The information area 205 may provide a surface adapted to receive a label, printing, or marking. In the case of printing, the information area 205 may provide a contrast to the print to allow the data thereon to be more easily viewed relative to the remainder of the dosing bag 200. Information within the information area 205 may include, by way of example, the date or the dose day indicator, a dose time, the drug name, the drug strength and the number of packets, drugs, or sachets in the specific dosing bag. Information beyond the drug may also be included in the information area 205. For example, the patient, the treatment location, the prescriber, the filling pharmacy, and/or adherence messaging may also be included within the information area 205. In some embodiments, images may be include with the information area (e.g., to facilitate adherence). Each individual dosing bag 200 may be different from other dosing bags 200 that form the dosing bag assembly 105 or the pharmaceutical packaging assembly 100. The drug dosage within the information area 205 may be the entire drug dose in the dosing bag 200. The dosing bag 200 may include a single drug type or may include multiple different drug types. Each drug name and drug dose may be included within the information area 205.

FIG. 3 is a view of a dosing bag 200 loaded with one or more sachets 300. Each sachet 300-1, 300-2, . . . 300-N is a container for an individual dose of a drug. The drug dose may be an incremental quantity of a drug, shown here as 125 mg of a drug. There are three sachets 200 illustrated, i.e., N=3, so if the sachets include the same drug and the same dose then the dosage bag 200 contains 375 mg of that drug as there are three sachets 300 in the dosing bag 200. However, the sachets 300 need not contain the same drug and/or the same quantity of the drug. For example, two sachets 300 may contain a first amount of a drug, e.g., 125 mg, and a third sachet 300 may contain a second quantity, e.g., 500 mg, of the same drug. Thus, the dosage bag 200 contains a non-multiple quantity of a drug relative to a sachet, here, e.g., 750 mg of the same drug.

While the term sachet 300 to refer to a mechanism use to store a pharmaceutical drug, other mechanisms may be used to store pharmaceutical drugs in addition to or instead of the sachets 300. In an example, packets may be used, a packet may include a paper body that is coated to increase its moisture resistance. The use of dosing bags 200 have different quantities of drugs and/or different types of drugs during the time period associated with the pharmaceutical packaging assembly 100 (e.g., on a day over day basis, on a week over week basis, during different time periods of the day, or otherwise). As such, the pharmaceutical packaging assembly 100 enables patients to more easily manage a complex drug treatment regimen. Pharmaceutical packaging assembly 100 may assist in improving compliance with a prescribed treatment regimen.

Figure 4A:
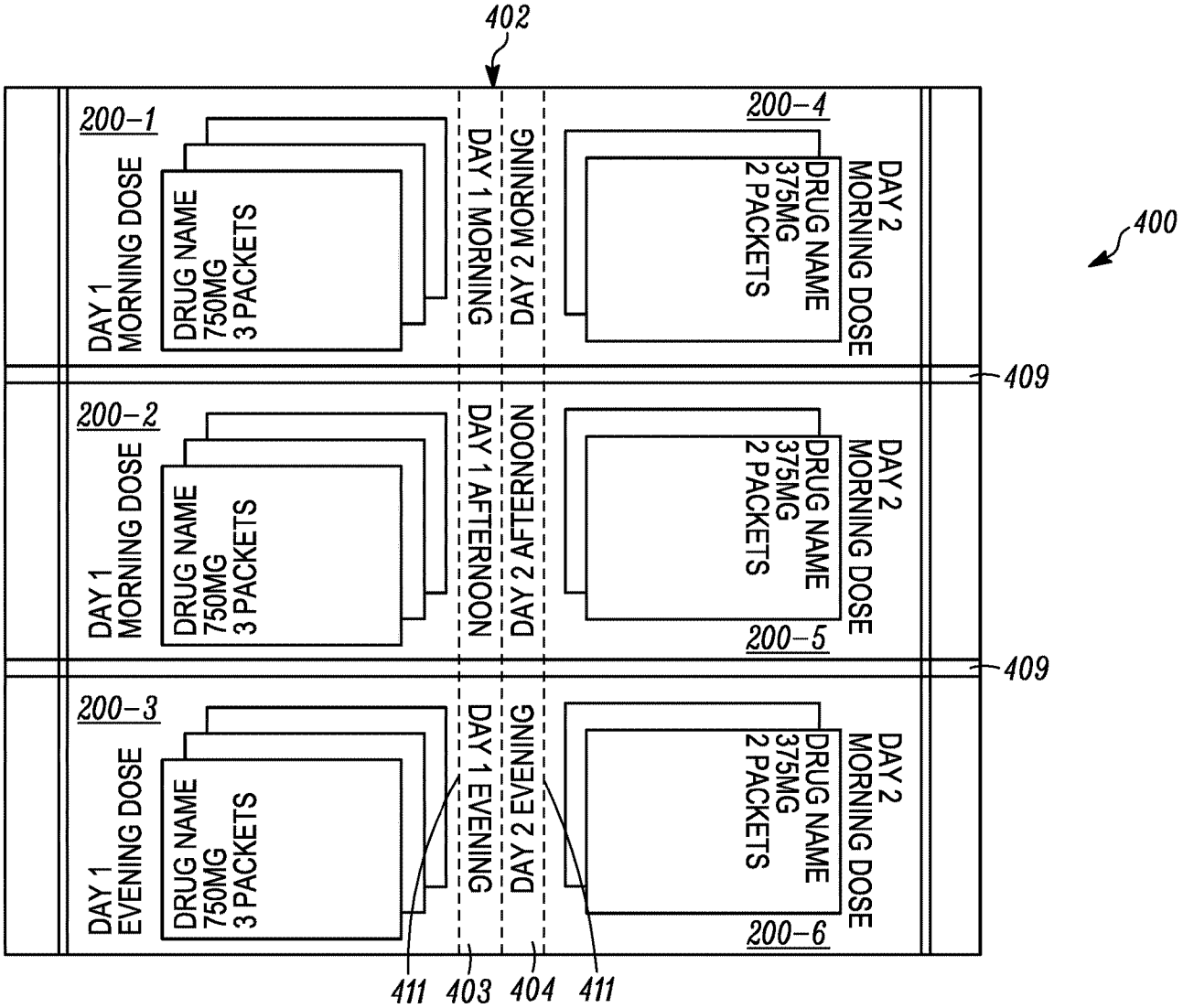
FIGS. 4A and 4B are views of a dosing bag assembly that may be deployed within the pharmaceutical packaging assembly of FIG. 1, according to an example embodiment.
Figure 4B:
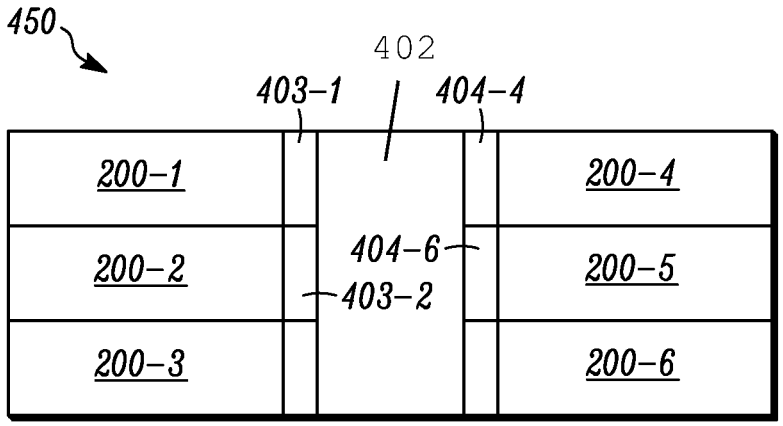

FIGS. 4A and 4B show dosing bag assemblies 400 that may include multiple dosing bags 200. These dosing bags 200 may be joined together to form a page in the pharmaceutical packaging assembly 100. That is, the dosing bag assembly 400 may form a page of a collection of pages between the covers 107, 108. The dosing bag assemblies 400 form the pages of a book-like pharmaceutical packaging assembly 100. Each of the dosing bag assemblies 400 are fixed within the pharmaceutical packaging assembly 100 by the booklet spine 109, the covers 107, 108, or otherwise, e.g., as described herein.

The dosing bags 200 of the dosing bag assembly 400 may be organized by the drug treatment regimen (e.g., as prescribed by the medical professional, as customized for and individual patient, or otherwise). The drug treatment regimen may be outside a standard treatment regimen based on the particular symptoms or physical state of a patient, e.g., based on a patient's age, patient's weight or potential side effects. As shown the dosing bags 200-1, 200-2 and 200-3 represent a time period (e.g., day one) for the patient to be administered a single drug or multiple drugs. The right side dosing bags 200-4, 200-5, and 200-6 represent a different time period (e.g., day two) for the patient to be administered a single drug or multiple drugs. The drugs in the first time period bags 200-1, 200-2 and 200-3 may be the same or at least one of the bags 200-1, 200-2 and 200-3 may contain different drug quantities and/or different drug types. The drugs in the second time period bags 200-4, 200-5 and 200-6 may be the same or at least one bag of the bags 200-4, 200-5 and 200-6 may contain different drug quantities or types relative to each other or to other bags, e.g., bags 200-1, 200-2 and 200-3. By way of example, the prescription drugs contained in the second time period bag 200-4 may have an increased amount relative to the corresponding first time period bag 200-1 and/or the prescription drugs contained in the second time period bag 200-6 may include an additional drug time not included in the corresponding first time period bag 200-6 while the remaining corresponding first and second time period bags have the same quantity and same drug type. The dosing bags 200 may also indicate a specific time that drug in a specific bag should be taken. This information may be supplied on the information area 205 (see FIG. 2).

Indicia may be included on the bags 200 and/or reflected through the dosing bags 200 to allow for certain differentiation. For example, the indicia of the dosing bags 200 may be color coded, and/or include an icon, a time of day, or the like printed on the dosing bag 200 to indicate when drug in that dosing bag 200 should be taken during the time period for the drug regimen. As shown, the first pair of dosing bags 200-1, 200-4 are to be taken in the morning and shown in a first color (e.g., yellow); the dosing bags 200-2, 200-5 are to be taken in the afternoon and shown in a second color (e.g., green); and the dosing bags 200-3, 200-6 are to be taken in the evening and shown in a third color (e.g., blue). Each of the first, second, and third colors are different from each other in an example embodiment. The bags 200 that are to be taken at a different time period but at a same time may be horizontally aligned to give the patient a visual organization of their drug regimen. The drugs to be taken at a same time of day may also be stacked such that different days are one above the other. In the FIG. 4A example, the odd treatment days (e.g., days 1, 3, 5, 7, etc.) of the treatment regimen may be stacked one above the other in the booklet 100 on the left side as shown in FIG. 4A. The even treatment days (e.g., days 2, 4, 6, 8, etc.) of the treatment regimen may be stacked one above the other in the booklet 100 on the right side as shown in FIG. 4A with the morning dosing bags 200 stacked above each other, with the afternoon dosing bags 200 stacked above each other, and with the evening dosing bags 200 stacked above each other.

The dosing bags 200 may be joined together along to form a single sheet, which may be a dosing bag assembly 105. The sheet may include an indication between each bag 200 whereat the bags may be separated from each other. Such an indication may be a border 409. The bags may be separated from each other at the borders 409. The borders 409 may include perforations that allow a bag 200 to be torn from an adjacent bag 200. In another example embodiment, the borders 409 may be cut to free a bag from an adjacent bag. In another example embodiment, the bags 200 are not joined together on a single sheet such that they have borders. For example, the bags 200 may be free flowing relative to each other but corresponding to other bags 200 for a particular day. The bags 200 may be individually affixed at the booklet spine 109 or to the pharmaceutical packaging assembly 100 to enable correspondence with other bags 200 for a particular day but may otherwise be free flowing, or otherwise at least partially movable relative to each other when fixed in the pharmaceutical packaging assembly 100.

Each of the dosing bags 200 in the assembly 400 may include a stub 403 or 404. The stub 403, 404 may be used to attach a dosing bag 200 or an assembly 400 to the outer covers 107, 108 or the booklet spine 109 of the pharmaceutical packaging assembly 100. The stubs 403, 404 may be adhered, glued, sewn, or otherwise bound to the booklet spine 109 or to other assemblies 400 and then fixed to the booklet spine 109. The stubs 403, 404 may be otherwise fixed together to form the pharmaceutical packaging assembly 100. For example, the stubs 403, 404 may be fixed together in a sequential order and then the first and last stubs are fixed to the booklet spine 109 or the front and rear covers 107, 108, respectively. The stubs 403, 404 may be removable from the dosing bag 200 so that the patient can track the drugs that have been taken or allow the dosing bag 200 to be removed while the stub remains fixed in the package 100. For example, the stub 403, 404 may be integrally formed with the dosing bag 200. A separation border 411 is provided to indicate where the dosing bag 200 may be removed from its respective stub 403 or 404. The separation border 411 may include perforations to allow the dosing bag to be torn from the stub 403, 404. The dosing bag 200 will remain closed at the end torn from the stub in an example embodiment.

FIG. 4B shows a dosing bag assembly 450 that is similar to the dosing bag assembly 400 as shown in FIG. 4A. Dosing bag assembly 450 includes an a binding area 402 between stubs 403 and 404. The binding area 402 is the location where a dosing bag assembly 450 is fixed to the booklet spine 109, e.g., by adhesive, glues or other binding technique, or fixed between the covers 107, 108. The binding area 402 may have a lateral width that is essentially equal to the width of the booklet spine 109. The longitudinal dimension, e.g., the booklet height, is the same or slightly less than the height of the booklet such that the covers extend slightly, e.g., 4 mm-8 mm beyond the edge of the dosing bag assemblies 450 when the pharmaceutical packaging assembly is assembled. In an example embodiment, the binding area 402, when assembled into pharmaceutical packaging assembly 100, forms a crease at the booklet spine 109 where it is fixed to the booklet spine 109. In an example embodiment, the binding area 404 can be reinforced relative to the other parts of the dosing bag assembly 450.

Figure 5:
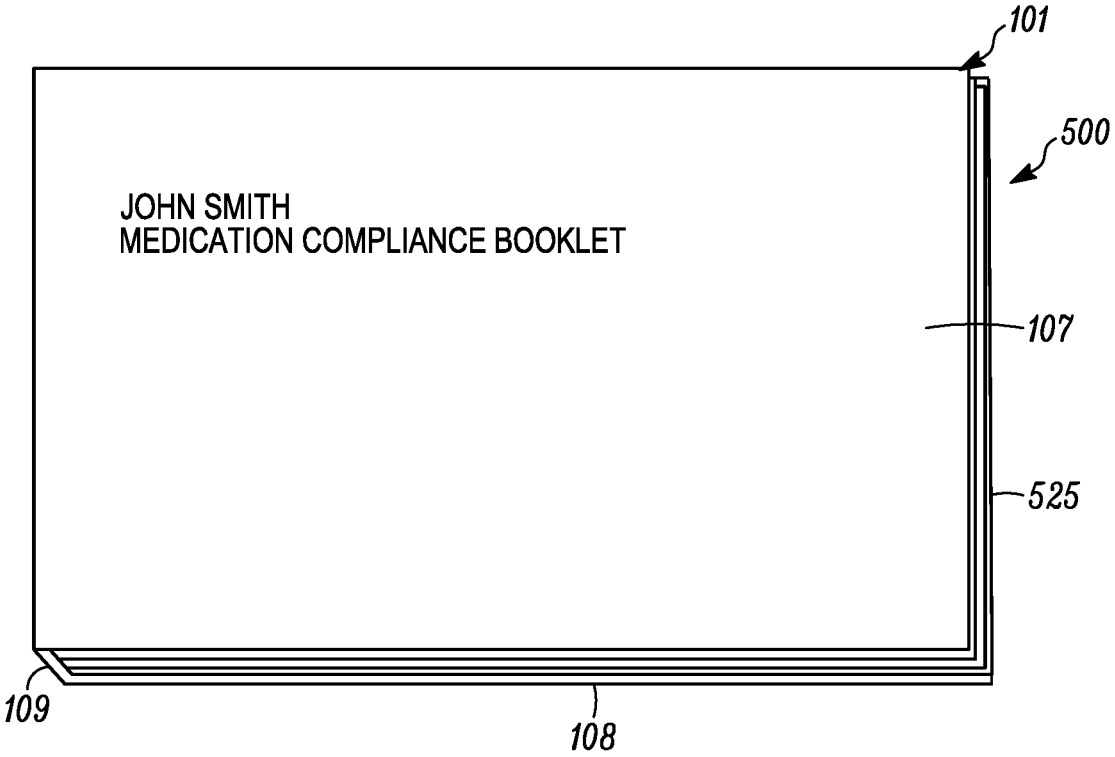
FIG. 5 is a view of a pharmaceutical packaging assembly, according to another example embodiment.

FIG. 5 is a view of another pharmaceutical packaging assembly 500 that includes multiple dosing assemblies 525 fixed between the covers 107, 108 at a booklet spine 109 according to another example embodiment. The fixation can be as described herein. The pharmaceutical packaging assembly 500 may be similar to pharmaceutical packaging assembly 100 but with the book spine 109 at a short edge relative to the pharmaceutical packaging assembly 100. The dosing bags 200 can be fixed at their shorter sides to each other and to the booklet spine 109. In an example embodiment, each of the multiple dosing assemblies 525 may represent all of the drug doses for a time period, e.g., a single day.

Figure 6A:
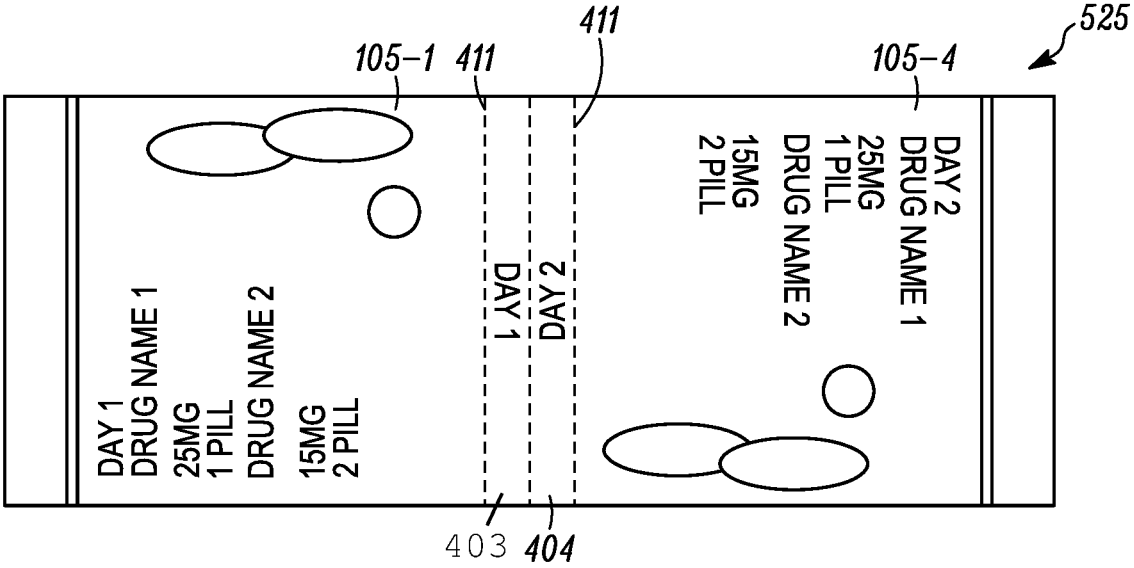
FIGS. 6A and 6B are views of dosing bag assemblies that may be deployed within the pharmaceutical packaging assembly of FIG. 5, according to an example embodiment.
Figure 6B:
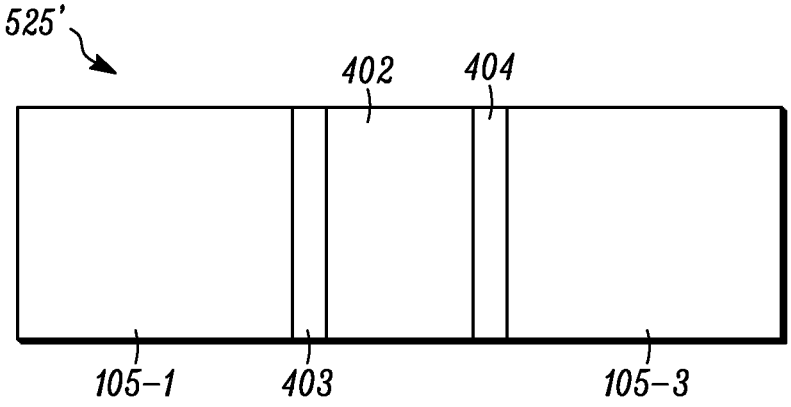

FIGS. 6A and 6B show views of a dosing bag assembly 525, 525' that may be deployed within the pharmaceutical packaging assembly 500 according to another example embodiment. The dosing bag assembly 525, 525' are the same as the dosing bag assemblies 400 and 450, respectively, with the difference that there is only a single dosing bag from a given time period. The dosing bag 525 includes the seal at the outer sides and the stubs 403, 404 at the center. The stubs 403, 404 can be joined together. The dosing bag 525' includes a binding area 402 between the stubs 403, 404.

The present systems and assemblies described herein can be used in a variety of ways. In use, each pharmaceutical dose is packaged into individual dosing bag 200, which is labeled with relevant dosing information. The individual dosing bags 200 may or may not be resealable (e.g., based on drug regimen, based on drug type, based on pharmacy preference, based on prescriber preference, or otherwise). Each dosing bag 200 may include drugs of a single drug type or of multiple drug types. The dosing bags 200 may be color coded for multiple daily doses or include other indicia. The dosing bags 200 can be formed into sheets that are bound in a book form, a binder form, or the like to form the pharmaceutical packaging assembly 500. In general, the pharmaceutical packaging assembly 500 is sent or otherwise provided to patient fully assembled and ready for administration.

When medication needs to be refilled, the shell (e.g., the covers 107, 108 and the book spine 109) of the pharmaceutical packaging assembly 100, 500 may either be disposed of and a new complete package sent with each refill, or re-used with new dosing bag assemblies (e.g., sheets of dosing bags) sent to the patient to insert into previous shell.

The pharmaceutical packaging assembly 100, 500 is adaptable to any particular prescription and may include single or multiple daily dosing, or both. The dosing bags 200 may also be empty if a particular day of period of time in a day is skipped in the drug regimen. Additional indicia may be included on such dosing bags 200 (e.g., a big black X) or a placebo (e.g., a sugar pill, a piece of candy, a vitamin or the like) may be included within such dosing bags 200 to reflect that a particular dosing or dosings do not have medication.

The patient may remove an individual dosing bag 200 from the package 100 to take that dose with them. In the case of specialty pharmaceuticals, a supply of drugs may be expensive and there is a risk of loss if the entire package 100, 500 is taken from home or a care facility. Further, in the case of children who attend school or daycare, the dosing bags 200 for particular time days (e.g., Monday through Friday) and/or particular time periods (e.g., afternoon dosing) and can be torn out ahead of time and stored at the school with the nurse. In an example embodiment, the dosing bags 200 are bound into a package spine with tearaway edge to allow separation from the pharmaceutical packaging assembly 100. In an example embodiment, multiple pharmaceutical packaging assemblies 100, 500 may be provided by the pharmacy such that one pharmaceutical packaging assembly 100, 500 with certain dosing is generally kept at the home of the patient and another pharmaceutical packaging assembly 100, 500 with the remainder of the dosing is generally kept at another location (e.g., an office of the patient or a nurse's office in a school. associated with the patient).

When a dosing bag 200 is removed, e.g., torn away, a stub with the dosing day (and time when applicable) remains in pharmaceutical packaging assembly 100, 500.

For multiple daily dosing, the pharmaceutical packaging assembly 100, 500 is structured with multiple indicia, e.g., color-coded sections, for each dosing time.

Each multiple dosing section may be connected with perforations in single-sheet form by day, or attached separately with each dosing section independent of the other(s). For example, the afternoon dosing bag(s) 200 for a school week may be removed for a school age child and sent to a school nurse or other school official. The morning and evening dosing bags 200 may remain in the pharmaceutical packaging assembly 100, 500 along with the non-school day afternoon dosing bags 200.

Dosing bags 200 may be attached to pharmaceutical packaging assembly 100, 500 shell via glue, adhesive, ringed binder, and/or locking mechanism.

The pharmaceutical packaging assemblies 100, 500 may thus be customized per patient, per treatment period, and/or per drug treatment regimen. The customization may enable a patient to justifiably rely on the construction and appearance of the pharmaceutical packaging assemblies 100, 500 to know whether the patient is being adherent with the drug treatment regimen and that the drug treatment regimen has properly been constructed (e.g., as prescribed by the prescriber for the patient).

Figure 7:
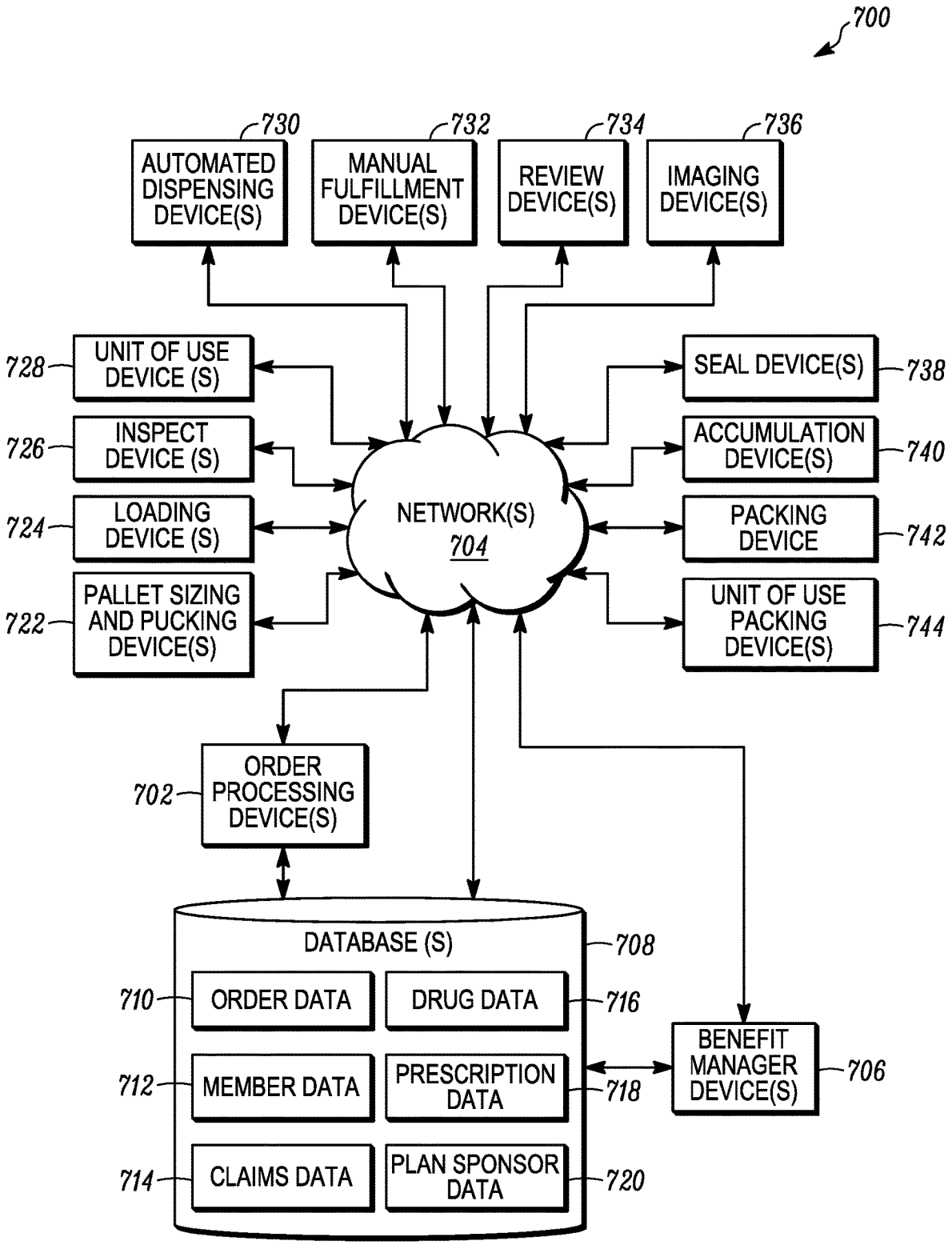
FIG. 7 is a block diagram of an example assembly, according to an example embodiment.

FIG. 7 illustrates a block diagram of an example system 700, according to an example embodiment. While the system 700 is generally described as being deployed in a high volume fulfillment center (e.g., a mail order pharmacy, a direct delivery pharmacy, and the like), the system 700 and/or components thereof may otherwise be deployed. The system 700 is an example system where the pharmaceutical packaging assembly 100, 500 may be filled and/or constructed a pharmaceutical packaging assembly as described herein. However, the pharmaceutical packaging assembly 100, 500 may otherwise be filled and/or constructed. For example, a pharmaceutical drug manufacture or a third party that is not the pharmacy or the drug manufacturer may fill and/or construct the pharmaceutical packaging assembly 100, 500. In an example embodiment, the pharmaceutical packaging assembly 100, 500 is constructed at the pharmacy using binding machines, drug pill counters, sealing machines, folding machines, printers, or the like The system 700 may include an order processing device 702 in communication with a benefit manager device 706 over a network 704. Additional devices which may be in communication with the benefit manager device 706 and/or the order processing device 702 over network 704 include: database(s) 708 which may store one or more than one of order data 710, member data 712, claims data 714, drug data 716, prescription data 718, and plan sponsor data 720; pallet sizing and pucking device(s) 722; loading device(s) 724; inspect device(s) 726; unit of use device(s) 728; automated dispensing device(s) 730; manual fulfillment device(s) 732; review device(s) 734; imaging device(s) 736; cap device(s) 738; accumulation device(s) 740; packing device(s) 742; and unit of use packing device(s) 744. The system 700 may also include additional devices.

The order processing device 702 may receive information about prescriptions being filled at a pharmacy in which the order processing device 702 is deployed. In general, the order processing device 702 is a device located within or otherwise associated with a pharmacy location to enable fulfillment of a prescription by dispensing prescription drugs. In some embodiments, the order processing device 702 may be a device separate from a pharmacy that enables communication with other devices located within a pharmacy. For example, the order processing device 702 may be in communication with another order processing device 702 and/or other devices 722-744 located with a pharmacy. In some embodiments, an external pharmacy order processing device 702 may have limited functionality (e.g., as operated by a patient requesting fulfillment of a prescription drug) when an internal pharmacy order processing device 702 may have greater functionality (e.g., as operated by a pharmacy).

The order processing device 702 can determine the number and types of drugs, e.g., pills and the like, that are to be placed in each sachet 300, sachet(s) in each dosing bag 200, and dosing bags that for a page in the pharmaceutical packaging assembly 100. The order processing device 702 can further track and use prepacked sachets 300 to appropriately fill the dosing bags 200.

The order processing device 702 may track a prescription order as it is fulfilled. A prescription order may include one or more than one prescription to be filled by the pharmacy. The order processing device 702 may make pharmacy routing decisions and/or order consolidation decisions for a prescription order. The pharmacy routing decisions include what device or devices in the pharmacy are responsible for filling at least a portion of the prescription order, where the order consolidation decisions include whether portions of a prescription order or multiple prescription orders should be shipped together for a patient or a patient family. The order processing device 702 may operate in combination with the benefit manager device 706. The pharmacy routing decision can also be based, at least in part, on a pharmacy's ability to fill a prescription with the pharmaceutical packaging assembly 100, e.g., with a specialty drug.

Examples of the order processing device 702 may include a machine dedicated to filling drug treatment regimens using the pharmaceutical packaging assembly 100, 500, e.g., dedicated processors. The order processing device 702 may also include other computing devices, such as desktop computing devices, notebook computing devices, netbook computing devices, and the like. The device 702 may include a processor, a memory to store data and instructions, and communication functionality. Other types of electronic devices that can use rules and instructions to execute various functions may also be used.

Examples of the network 704 include Mobile Communications (GSM) network, a code division multiple access (CDMA) network, 3rd Generation Partnership Project (3GPP), an Internet Protocol (IP) network, a Wireless Application Protocol (WAP) network, a WiFi network, or an IEEE 802.11 standards network, as well as various combinations thereof. The network 704 may include optical communications. The network 704 may be a local area network or a global communication network, such as the Internet. Other conventional and/or later developed wired and wireless networks may also be used. In some embodiments, the network 704 may include a prescribing network such as the electronic prescribing network operated by Surescripts of Arlington, Va.

The benefit manager device 706 is a device operated by an entity at least partially responsible for creation and/or management of the pharmacy or drug benefit. While the benefit manager operating the benefit manager device 706 is typically a pharmacy benefit manager (PBM), other entities may operate the benefit manager device 706 either on behalf of themselves, the PBM, or another entity. For example, the benefit manager may be operated by a health plan, a retail pharmacy chain, a drug wholesaler, a data analytics or other type of software-related company, or the like. In some embodiments, a PBM that provides the pharmacy benefit may also provide one or more than one additional benefits including a health benefit, a dental benefit, a vision benefit, a wellness benefit, a radiology benefit, a pet care benefit, an insurance benefit, a long term care benefit, a nursing home benefit, and the like. The PBM may, in addition to its PBM operations, operate one or more than one pharmacy.

Some of the operations of the PBM that operates the benefit manager device 706 may include the following. A member (or a person on behalf of the member) of a pharmacy benefit plan administered by or through the PBM attempts to obtain a prescription drug at a retail pharmacy location where the member can obtain drugs in a physical store from a pharmacist or pharmacist technician, or in some instances through mail order drug delivery from a mail order pharmacy location. The member may also obtain a prescription drug directly or indirectly through the use of a machine, such as a kiosk, vending unit, mobile electronic device, or a different type of mechanical, electrical, an electronic communication device and/or computing device. The member may also be required to fill a specialty drug prescription using a package 100.

The member may have a co-pay for the prescription drug that reflects an amount of money that the member is responsible to pay the pharmacy for the prescription drug. The money paid by the member to the pharmacy may come from the personal funds of the member, a health savings account (HSA) of the member or the member's family, a health reimbursement arrangement (HRA) of the member or the member's family, a flexible spending accounts (FSA) of the member or the member's family, or the like. An employer of the member may directly or indirectly fund or reimburse the member or an account of the member for the co-pay.

The amount of the co-pay paid by the member may vary by the benefit plan of a plan sponsor or client with the PBM. The member's co-pay may be based on a flat co-pay (e.g., $10), co-insurance (e.g., 10%), and/or a deductible (e.g., for first $500 of annual prescription drug spend) for certain prescription drugs, certain types of prescription drugs, and/or all prescription drugs.

In certain instances, the member may not pay the co-pay or may only pay for a portion of a co-pay for a prescription drug. For example, if the usual and customary cost for a generic version of a prescription drug is $4, and the member's flat co-pay is $20 for the prescription drug, the member may only pay $4 to receive the prescription drug. In another example involving a worker's compensation claim, no co-pay may be due by the member for the prescription drug. The co-pay may also vary based on the channel used to receive the prescription drug. For example, the co-pay for receiving prescription drug from a mail order pharmacy location may be less than the co-pay for receiving prescription drug from a retail pharmacy location.

In conjunction with receiving the co-pay (if any) from the member and dispensing the prescription drug to the member, the pharmacy submits a claim to the PBM for the prescription drug. The PBM may perform certain adjudication operations including verifying the eligibility of the member, reviewing the formulary of the member to determine appropriate co-pay, coinsurance, and deductible for the prescription drug, and performing a drug utilization review (DUR) on the member. The PBM then provides a response to the pharmacy following performance of at least some of the aforementioned operations. As part of the adjudication, the plan sponsor (or the PBM on behalf of the plan sponsor) ultimately reimburses the pharmacy for filling the prescription drug when the prescription drug was successfully adjudicated. The aforementioned adjudication operations generally occur before the co-pay is received and the prescription drug dispensed. However, the operations may occur simultaneously, substantially simultaneously, or in a different order. In addition, more or less adjudication operations may be performed as at least part of the adjudication process.

The amount of reimbursement paid to the pharmacy by a plan sponsor and/or money paid by the member may be based at least in part on the type of pharmacy network in which the pharmacy is included. Other factors may be used to determine the amount in addition to the type of pharmacy network. For example, if the member pays the pharmacy for the prescription without using the prescription drug benefit provided by the benefit manager, the amount of money paid by the member may be higher and the amount of money received by the pharmacy for dispensing the prescription drug and for the prescription drug itself may be higher. Some or all of the foregoing operations may be performed by executing instructions on the benefit manager device 706 and/or an additional device.

In some embodiments, at least some of the functionality of the order processing device 702 may be included in the benefit manager device 706. The order processing device 702 may be in a client-server relationship with the benefit manager device 706, a peer-to-peer relationship with the benefit manager device 706, or in a different type of relationship with the benefit manager device 706.

The order processing device 702 and/or the benefit manager device 706 may be in communication directly (e.g., through local storage) and/or through the network 704 (e.g., in a cloud configuration or software as a service) with a database 708 (e.g., as may be retained in memory or otherwise). The database 708 may store order data 710, member data 712, claims data 714, drug data 716, prescription data 718, and/or plan sponsor data 720. Other data may be stored in the database 708.

The order data 710 may include data related to the order of prescriptions including the type (e.g., drug name and strength) and quantity of each prescription in a prescription order. The order data 710 may also include data used for completion of the prescription, such as prescription materials. In general, prescription materials are a type of order materials that include an electronic copy of information regarding the prescription drug for inclusion with or otherwise in conjunction with the fulfilled prescription. The prescription materials may include electronic information regarding drug interaction warnings, recommended usage, possible side effects, expiration date, date of prescribing, or the like. The order data 710 may be used by a high volume fulfillment center to fulfill a pharmacy order. The order data 710 may include the type of package, e.g., the pharmaceutical packaging assembly 100. The order data 710 may include the indicia information 205 on a dosing bag 200, the type of page 400, 450', 525, 525' to be included in the package, and whether the drug will include sachets 300. The order data 710 may further include color coding of the dosing bags 200 as well as associate labeling on the pages 400, 525 and stubs 403, 404. In an example embodiment, the order 710 can be used to generate the color coding and information to be placed on the pharmaceutical packaging assembly 100, 500 or elements of the package 100, 500.

In some embodiments, the order data 710 includes verification information associated with fulfillment of the prescription in the pharmacy. For example, the order data 710 may include videos and/or images taken of (i) the prescription drug prior to dispensing, during dispensing, and/or after dispensing, (ii) the prescription container (e.g., a prescription bottle and sealing lid) used to contain the prescription drug prior to dispensing, during dispensing, and/or after dispensing, (iii) the packaging and/or packaging materials used to ship or otherwise deliver the prescription drug prior to dispensing, during dispensing, and/or after dispensing, and/or (iv) the fulfillment process within the pharmacy. Other type of verification information such as bar code data read from pallets used to transport prescriptions within the pharmacy may also be stored as order data 710.

The member data 712 includes information regarding the members associated with the benefit manager. Examples of the member data 712 include name, address, telephone number, e-mail address, prescription drug history, and the like. The member data 712 may include a plan sponsor identifier that identifies the plan sponsor associated with the member and/or a member identifier that identifies the member to the plan sponsor. The member data 712 may include a member identifier that identifies the plan sponsor associated with the patient and/or a patient identifier that identifies the patient to the plan sponsor. The member data 712 may also include, by way of example, dispensation preferences such as type of label, type of cap, message preferences, language preferences, or the like. Such member data 712 may be placed on the front cover 107 of the pharmaceutical packaging assembly 100, 500 or on each of the dosing bags 200.

The member data 712 may be accessed by various devices in the pharmacy, e.g., the high volume fulfillment center, to obtain information utilized for fulfillment and shipping of prescription orders. In some embodiments, an external order processing device 702 operated by or on behalf of a member may have access to at least a portion of the member data 112 for review, verification, or other purposes.

In some embodiments, the member data 712 may include information for persons who are patients of the pharmacy but are not members in a benefit plan being provided by the benefit manager. For example, these patients may obtain drug directly from the pharmacy, through a private label service offered by the pharmacy, the high volume fulfillment center, or otherwise. In general, the use of the terms member and patient may be used interchangeably herein.

The claims data 714 includes information regarding pharmacy claims adjudicated by the PBM under a drug benefit program provided by the PBM for one, or more than one, plan sponsors. In general, the claims data 714 includes an identification of the client that sponsors the drug benefit program under which the claim is made, and/or the member that purchased the prescription drug giving rise to the claim, the prescription drug that was filled by the pharmacy (e.g., the national drug code number), the dispensing date, generic indicator, GPI number, medication class, the cost of the prescription drug provided under the drug benefit program, the copay/coinsurance amount, rebate information, and/or member eligibility. Additional information may be included. The claims data 714 may also include the type of package 100 in which the prescription order was filled and sent to the patient.

In some embodiments, other types of claims beyond prescription drug claims may be stored in the claims data 714. For example, medical claims, dental claims, wellness claims, or other type of health care-related claims for members may be stored as a portion of the claims data 714.

In some embodiments, the claims data 714 includes claims that identify the members with whom the claims are associated. In some embodiments, the claims data 714 includes claims that have been de-identified (e.g., associated with a unique identifier but not with a particular, identifiable member).

The drug data 716 may include drug name (e.g., technical name and/or common name), other names by which the drug is known by, active ingredients, an image of the drug (e.g., in pill form), and the like. The drug data 716 may include information associated with a single medication or multiple medications.

The prescription data 718 may include information regarding prescriptions that may be issued by prescribers on behalf of patients, who may be members of the drug benefit plan, for example to be filled by a pharmacy. Examples of the prescription data 718 include patient names, medication or treatment (such as lab tests), dosing information, and the like. The prescriptions may be electronic prescriptions, paper prescriptions that have been scanned, or otherwise. In some embodiments, the dosing information reflects a frequency of use (e.g., once a day, twice a day, before each meal, etc.) and a duration of use (e.g., a few days, a week, a few weeks, a month, etc.).

In some embodiments, the order data 710 may be linked to associated member data 712, claims data 714, drug data 716, and/or prescription data 718.

The plan sponsor data 720 includes information regarding the plan sponsors of the benefit manager. Examples of the plan sponsor data 720 include company name, company address, contact name, contact telephone number, contact e-mail address, and the like.

The order processing device 702 may direct at least some of the operations of devices 722-744, recited above. In some embodiments, operations performed by one of these devices 722-744 may be performed sequentially, or in parallel with the operations of another device as may be coordinated by the order processing device 702. In some embodiments, the order processing device 702 tracks a prescription with the pharmacy based on operations performed by one or more of the devices 722-744.

In some embodiments, the system 700 may transport prescription drug containers (e.g., between one or more than one of the devices 722-744 in the high volume fulfillment center) by use of pallets. The pallet sizing and pucking device 722 may configure pucks in a pallet. A pallet may be a transport structure for a number of prescription containers, and may include a number of cavities. A puck may be placed in one or more than one of the cavities in a pallet by the pallet sizing and pucking device 722. A puck may include a receptacle sized and shaped to receive a prescription container. Such containers may be supported by the pucks during carriage in the pallet.

Different pucks may have differently sized and shaped receptacles to accommodate containers of differing sizes, as may be appropriate for different prescriptions. The pucks can be adapted to hold sachets 300, dosing packages 200 or pages of dosing packages.

The arrangement of pucks in a pallet may be determined by the order processing device 702 based on prescriptions which the order processing device 702 decides to launch. In general, prescription orders in the order database 710 reside in one or more than one queues, and are generally launched in a first-in-first-out order. However, the order processing device 702 may use logic and a variety of factors to determine when and how prescriptions are to be launched. For example, some non-limiting factors which may alter the first-in-first-out order of launching prescriptions in a pharmacy include the age of the order, whether the order required an outreach to a physician or some other intervention, whether there are any performance guarantees with plan sponsors or members, the available inventory of a given pharmaceutical in view of existing prescriptions already launched which will require that pharmaceutical, the zip code to which the order will be shipped, the workload and volume of various parts of the pharmacy, whether valid paperwork for the order has been received, and/or similar orders for the same pharmaceutical that are already to be launched. The logic may be implemented directly in the pallet sizing and pucking device 722, in the order processing device 702, in both devices 702, 722, or otherwise. Once a prescription is set to be launched, a puck suitable for the appropriate size of container for that prescription may be positioned in a pallet by a robotic arm or pickers. The pallet sizing and pucking device 722 may launch a pallet once pucks have been configured in the pallet.

The loading device 724 may load prescription containers, e.g., pharmaceutical packaging assemblies 100, sachets 300, dosing bags 200, or pages 105 of dosing bags 200 into the pucks on a pallet by a robotic arm, pick and place mechanism, or the like. In one embodiment, the loading device 708 has robotic arms or pickers to grasp a prescription container and move it to and from a pallet or a puck. The loading device 724 may also print a label which is appropriate for a container that is to be loaded onto the pallet, and apply the label to the container, e.g., pharmaceutical packaging assemblies 100, sachets 300, dosing bags 200, or pages of dosing bags 105. The pallet may be located on a conveyor assembly during these operations, e.g., at the high volume fulfillment center.

The inspect device 726 may verify that containers in a pallet are correctly labeled and in the correct spot on the pallet. The inspect device 726 may scan the label on one or more than one container on the pallet. Labels of containers may be scanned or imaged in full or in part by the inspect device 726. Such imaging may occur after the container has been lifted out of its puck by a robotic arm, picker, or the like, or may be otherwise scanned or imaged while retained in the puck. In some embodiments, images and/or video captured by the inspect device 726 may be stored in the database 708 as order data 710.

The unit of use device 728 may temporarily store, monitor, label and/or dispense unit of use products. In general, unit of use products are prescription drug products that may be delivered to a patient or member without being repackaged at the pharmacy. These products may include pills in a container, pills in a blister pack, inhalers, and the like. Prescription drug products dispensed by the unit of use device 728 may be packaged individually or collectively for shipping, or may be shipped in combination with other prescription drugs dispenses by other devices in the high volume fulfillment center. The unit of use device 728 may include pre-packaged pharmaceutical packaging assemblies 100 or dosing bags 200 or pages 105 of dosing bags to be included in a package 100. In some instances, a drug regimen is ordered frequently enough in a pharmaceutical packaging assembly such that the particular page or package itself is pre-assembled as a unit of use structure. Such a pre-assembled page may be dispensed by the unit-of-use device 728.

The automated dispensing device 730 may include one or more than one devices that dispense prescription drugs or pharmaceuticals into prescription containers in accordance with one or multiple prescription orders. In general, the automated dispensing device 730 may include mechanical and electronic components with, in some embodiments, software and/or logic to facilitate pharmaceutical dispensing that would otherwise be performed in a manual fashion by a pharmacist and/or pharmacist technician. For example, the automated dispensing device 730 may include high volume fillers that fill a number of prescription drug types at a rapid rate and blister pack machines that dispense and pack drugs into a blister pack. Prescription drugs dispensed by the automated dispensing devices 730 may be packaged individually or collectively for shipping, or may be shipped in combination with other prescription drugs dispenses by other devices in the high volume fulfillment center.

The manual fulfillment device 732 may provide for manually fulfillment of prescriptions. For example, the manual fulfillment device 732 may receive or obtain a container and enable fulfillment of the container by a pharmacist or pharmacy technician. In some embodiments, the manual fulfillment device 732 provides the filled container to another device in the system 700 to be joined with other containers in a prescription order for a patient or member. In general, a manual fulfillment may include operations at least partially performed by a pharmacist or pharmacy technician. For example, a person may retrieve a supply of the prescribed drug, may make an observation, may count out a prescribed quantity of drugs and place them into a prescription container, or the like. Some portions of the manual fulfillment process may be automated by use of a machine. For example, counting of capsules, tablets, or pills may be at least partially automated (e.g., through use of a pill counter). Prescription drugs dispensed by the manual fulfillment device 732 may be packaged individually or collectively for shipping, or may be shipped in combination with other prescription drugs dispenses by other devices in the high volume fulfillment center. The manual fulfillment device 732 may also be used to package sachets 300 or dosing bags 200 and create the dosing pages 400 that are mounted in the pharmaceutical packaging assemblies 100, 500.

The review device 734 may process prescription containers, e.g., pharmaceutical packaging assemblies 100, sachets 300, dosing bags 200, or pages of dosing bags 105 to be reviewed by a pharmacist for proper pill count, exception handling, prescription verification, and the like. Fulfilled prescriptions may be manually reviewed and/or verified by a pharmacist, as may be required by state or local law. A pharmacist or other licensed pharmacy person who may dispense certain drugs in compliance with local and/or other laws may operate the review device 734 and visually inspect a prescription container that has been filled with a prescription drug. The pharmacist may review, verify, and/or evaluate drug quantity, drug strength, and/or drug interaction concerns, or otherwise perform pharmacist services. The pharmacist may also handle containers which have been flagged as an exception, such as containers with unreadable labels, containers for which the associated prescription order has been cancelled, containers with defects, and the like.

The imaging device 736 may image containers once they have been filled with pharmaceuticals. The imaging device 736 may measure the fill height of the pharmaceuticals in the container based on the obtained image to determine if the container is filled to the correct height given the type of pharmaceutical and the number of pills in the prescription. Images of the pills in the container may also be obtained to detect the size of the pills themselves and markings thereon. The images may be transmitted to the order processing device 702, and/or stored in the database 710 as part of the order data 710.

The seal device 738 may be used to seal a dosing bag 200. In some embodiments, the seal device 738 may secure a dosing bag 200. The seal device may further emboss the dosing bag 200 with information thereon, e.g., a plan sponsor preference, a prescriber preference, or the like.

The accumulation device 740 accumulates various containers of prescription drugs in a prescription order. The accumulation device 740 may accumulate prescription containers from various devices or areas of the pharmacy. For example, the accumulation device 740 may accumulate prescription containers from the unit of use device 728, the automated dispensing device 730, the manual fulfillment device 732, and the review device 734, and pharmaceutical packaging assemblies 100, 500. The accumulation device 740 may be used to group the prescription containers prior to shipment to the member or otherwise. The accumulation device 740 may put together a assembly 100, 500 with traditional drug packages and containers.

The packing device 742 packages a prescription order in preparation for shipping the order. The packing device 742 may box, bag, or otherwise package the fulfilled prescription order for delivery. The packing device 742 may further place inserts into the packaging. For example, bulk prescription orders may be shipped in a box, while other prescription orders may be shipped in a bag which may be a wrap seal bag. The packing device 742 may label the box or bag with the address and a recipient's name. The packing device 742 may sort the box or bag for mailing in an efficient manner (e.g., sort by delivery address). The packing device 742 may include ice or temperature sensitive elements for prescriptions which are to be kept within a temperature range during shipping in order to retain efficacy or otherwise. The ultimate package may then be shipped through postal mail, through a mail order delivery service that ships via group and/or air (e.g., UPS, FedEx, or DHL), through delivery service, through a locker box at a shipping site (e.g., Amazon locker or a PO Box), or otherwise.

The unit of use packing device 744 packages a unit of use prescription order in preparation for shipping the order. The unit of use packing device 744 may include manual scanning of containers to be bagged for shipping to verify each container and/or drug package in the order.

While the system 700 in FIG. 7 is shown to include single devices 702, 706, 722-744 multiple devices may be used. The devices 702, 706, 722-744 may be the same type or model of device or may be different device types or models. When multiple devices are present, the multiple devices may be of the same device type or models or may be a different device type or model. The types of devices 702, 706, 722-744 shown in FIG. 7 are example devices. In other configurations of the system 700, lesser, additional, or different types of devices may be included.

Moreover, the system 700 shows a single network 704; however, multiple networks can be used. The multiple networks may communicate in series with each other to link the devices 702, 706, 722-744 or in parallel to link the devices 702, 706, 722-744. Multiple devices may share processing and/or memory resources. The devices 702, 706, 722-744 may be located in the same area or in different locations. For example, the devices 702, 706, 722-744 may be located in a building or set of adjoining buildings. The devices 702, 706, 722-744 may be interconnected (e.g. by conveyors), networked, and/or otherwise in contact with one another or integrated with one another, e.g., at the high volume fulfillment center. In addition, the functionality of a device may be split among a number of discrete devices and/or combined with other devices.

Figure 8:
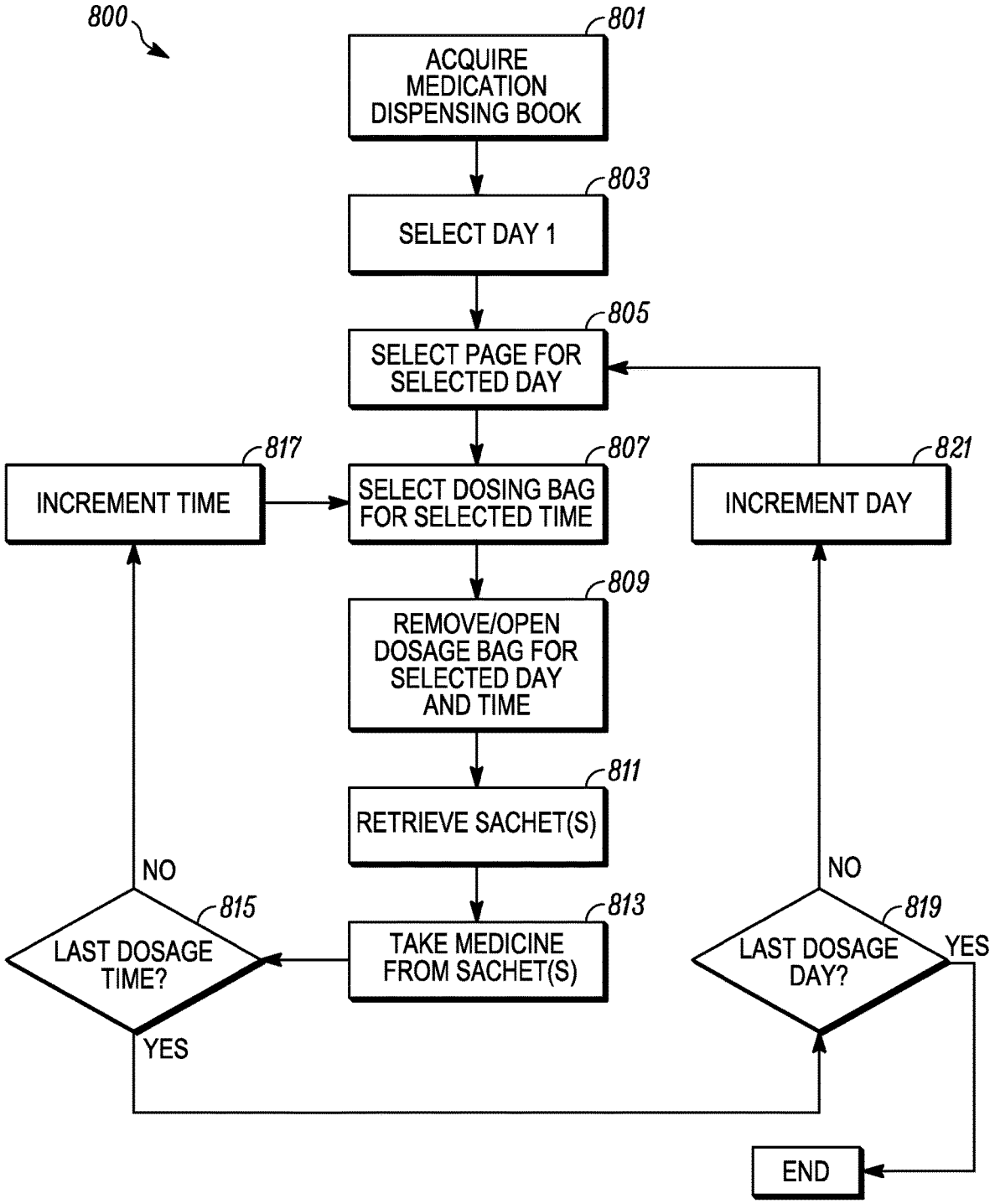
FIG. 8 is a flow chart of a method according to an example embodiment.

FIG. 8 shows a method 800 according to an example embodiment. At 801, a patient receives a book 100 as described herein. The book 100 includes pages that may include dosing bag assemblies 105, which each include one or more dosing bags 200. The dosing bags 200 contain a specified dose for the patient's treatment regimen. The dosing bags include at least one sachet that contains one or more scheduled treatments, e.g., pharmaceuticals. The book 100 is organized such that the patient need only take their treatment at the appointed time and take all of the treatments stored in the single dosing bag. The treatments may be different between dosing bags. At 803, the first day is selected by the patient. At 805, the patient chooses the selected day in the book. For the day one, the first page of one of the first pages in the book is selected. Typically, the day one bag assembly will be the first page or one of the first pages in the book, e.g., immediately adjacent the front cover of the book. At 807, the dosing time is selected. The dosing time(s) are set by the prescription, e.g., once a day, twice a day, three times a day and so on. The number of dosage bags for a given day (time period) is set based on the highest number of treatments for any given day (time period). If a drug treatment is taken each day during the prescription period of the book, then that time for the skipped day will have a dosing bag, which may contain a placebo or be empty. An empty bag will be so indicated so as to not unnecessarily worry a patient. Thus, the book will contain a dosage bag for the highest number of treatments in a first time period (e.g., a day) for the number of first time periods. For example, is a patient is administered a treatment N times in the first time period for M first time period in a second longer time period, then the number of dosage bags is N*M. If a patient takes a maximum of three treatments a day (first time period) for thirty days (the second time period), then the number of dosage bags is ninety.

At 807, the dosage time is selected and the patient is directed to the correct single dosage bag for that day and time. At 809, that single dosage bag is opened or removed from the book. At 811, the sachet(s) in the dosage bag are removed thereform. The patient may confirm the contents based on the indicia on the dosage bag or based on a printed page secured in the book that described the type and number of treatments in the dosage bag. At 813, the patient takes the complete dose from all of the sachets in the dosage bag.

At 815, if it is determined if that is the last treatment for the first time period (e.g., a day). If not, then the time is incremented at 817. Then the method proceeds back to step 807. If the last treatment has been administered, then the method proceeds to step 819, whereat it is determined if the method has completed the first time periods. If so, the treatment is complete and the method can end. If not, then the first time period is incremented at 819. Then the method returns to step 805.

At 815, if it is determined that the treatment

The inventive subject matter may be represented in a variety of different embodiments of which there are many possible permutations.

While the methods and systems described herein generally reflect the medication delivery systems that may distribute prescription drugs, other materials may be so packaged with the assemblies described herein. Examples of other materials include vitamins, over the counter drugs, marijuana, candy, placebos and the like.

Thus, methods, systems, and assemblies for drug delivery and storage have been described. Although embodiments of the present invention have been described with reference to specific example embodiments, it will be evident that various modifications and changes may be made to these embodiments without departing from the broader spirit and scope of the embodiments of the invention. Accordingly, the specification and drawings are to be regarded in an illustrative rather than a restrictive sense.

The invention claimed is:

1. A medication packaging assembly for individual dosing comprising:

a plurality of packets each configured to store at least one medication;

a first dosing bag configured to hold a first packet of the plurality of packets, and the first dosing bag being further configured to store a first specific medication dose defined by the first packet of the plurality of packets;

a second dosing bag configured to hold a second packet of the plurality of packets, and the second dosing bag being further configured to store a second specific medication dose defined by the second packet of the plurality of packets; and a plurality of dosing bag assemblies each configured to store at least one of the first dosing bag and the second dosing bag joined at a dosing bag separation border, the plurality of dosing bag assemblies being connected together at a binding area to form a package, wherein the binding area includes a stub for each of the first dosing bag and the second dosing bag with the stub being connected to the respective one of the first dosing bag and the second dosing bag at the dosing bag separation border to provide a selectable separation location for the first and second dosing bags from the stubs at the binding area, the stubs including indicia related to the first and second dosing bags and remaining at the binding area with the first and second dosing bags being removed.

2. The medication packaging assembly of claim 1, further comprising:

a first medication dose of a first medication, the first specific medication dose being stored within the first dosing bag; and a second medication dose of a second medication, the second specific medication dose being stored within the second dosing bag.

3. The medication packaging assembly of claim 2, wherein the first dosing bag includes a body that forms a recess with an open top, the recess in the body being enclosed by the body, the first specific medication dose being stored within the recess of the first dosing bag.

4. The medication packaging assembly of claim 3, wherein the first dosing bag further includes a seal provided at the open top to close the recess when the first specific medication dose is stored therein.

5. The medication packaging assembly of claim 1, wherein the plurality of packets are each organized among the plurality of dosing bag assemblies in accordance with a dosing regimen.

6. The medication packaging assembly of claim 1, wherein the plurality of dosing bag assemblies are joined at the binding area to form a book with the plurality of dosing bag assemblies being stacked on top of each other.

7. The medication packaging assembly of claim 6, wherein the book includes an outer cover that at least partially encloses the plurality of dosing bag assemblies, and wherein a first portion of the outer cover and a second portion of the outer cover are joined by a book spine that is fixed to the binding area.

8. The medication packaging assembly of claim 7, wherein stitching through the book spine fixes the plurality of dosing bag assemblies to the outer cover.

9. The medication packaging assembly of claim 1, wherein the first specific medication dose is of a same type of medication as the second specific medication dose, and the first specific medication dose is of a different dosage amount than the second specific medication dose.

10. A pharmaceutical packaging assembly for individual dosing comprising:

a first dosing bag being configured to store a first specific dose of a first prescription drug;

a second dosing bag configured to store a second specific dose of a second prescription drug; and a plurality of dosing bag assemblies each configured to store at least one of the first dosing bag and the second dosing bag joined at a dosing bag separation border, the plurality of dosing bag assemblies being connected together at a binding area to form a package, wherein the binding area includes a first stub for the first dosing bag and a second stub for the second dosing bag, the first stub being connected to the first dosing bag at the dosing bag separation border to provide a selectable separation location for the first dosing bag from the first stub at the binding area, the second stub being connected to the second dosing bag at the dosing bag separation border to provide a selectable separation location for the second dosing bag from the second stub at the binding area, the first stub including first indicia related to the first dosing bag and the second stub including second indicia related to the second dosing bag, the first stub remaining at the binding area when the first dosing bag is removed and the second stub remaining at the binding area when the second dosing bag is removed.

11. The pharmaceutical packaging assembly of claim 10, wherein the plurality of dosing bag assemblies further comprises:

a first dosing bag assembly including a first set of dosing bags including the first dosing bag positioned to open to a first side; and a second dosing bag assembly including a second set of dosing bags including the second dosing bag positioned to open to a second side that is in a different direction than the first side, wherein the first dosing bag assembly is joined to the binding area at the first stub away from the first side and the second dosing bag assembly is joined to the binding area at the second stub away from the second side.

12. The pharmaceutical packaging assembly of claim 11, wherein the binding area spaces the first set of dosing bags and the second set of dosing bags.

13. The pharmaceutical packaging assembly of claim 11, wherein the plurality of dosing bag assemblies are joined at the binding area to form a book with the plurality of dosing bag assemblies being stacked on top of each other.

14. The pharmaceutical packaging assembly of claim 11, wherein the plurality of dosing bag assemblies each include a unique identifier to individually identify a medication dose; and wherein both the first dosing bag and the second dosing bag include a label to identify the dosing in the first dosing bag and the second dosing bag, respectively.

15. The pharmaceutical packaging assembly of claim 10, wherein the first prescription drug is different than the second prescription drug.

16. A medication packaging assembly for individual dosing comprising:

a plurality of sachets each configured to store at least one medication;

a first dosing bag configured to hold a first sachet of the plurality of sachets, and the first dosing bag being further configured to store a specific medication dose defined by the first sachet of the plurality of sachets;

a second dosing bag configured to hold a second sachet of the plurality of sachets, and the second dosing bag being further configured to store a placebo defined by the second sachet of the plurality of sachets; and a plurality of dosing bag assemblies each configured to store at least one of the first dosing bag and the second dosing bag joined at a dosing bag separation border, the plurality of dosing bag assemblies being connected together at a binding area to form a package, wherein the binding area includes a stub for each of the first dosing bag and the second dosing bag with the stub being connected to the respective one of the first dosing bag and the second dosing bag at the dosing bag separation border to provide a selectable separation location for the first and second dosing bags from the stubs at the binding area, the stubs including indicia related to the first and second dosing bags and remaining at the binding area with the first and second dosing bags being removed.

17. The medication packaging assembly of claim 16, wherein the selectable separation location includes a plurality of perforations.

18. The medication packaging assembly of claim 16, wherein the dosing bag separation border includes a plurality of perforations.

19. A medication packaging assembly for individual dosing comprising:

a plurality of packets each configured to store at least one medication;

a first dosing bag configured to hold a first packet of the plurality of packets, and the first dosing bag being further configured to store a first specific medication dose defined by the first packet of the plurality of packets, wherein the first dosing bag includes a body that forms a recess with an open top, the recess in the body being enclosed by the body and being configured to store a first specific medication dose being stored therein;

a second dosing bag configured to hold a second packet of the plurality of packets, and the second dosing bag being further configured to store a second specific medication dose defined by the second packet of the plurality of packets; and a plurality of dosing bag assemblies each configured to store at least one of the first dosing bag and the second dosing bag joined at a dosing bag separation border, the plurality of dosing bag assemblies being connected together at a binding area to form a package, wherein the binding area includes a stub for each of the first dosing bag and the second dosing bag with the stub being connected to the respective one of the first dosing bag and the second dosing bag at the dosing bag separation border to provide a selectable separation location for the first and second dosing bags from the stubs at the binding area, the stubs including indicia related to the first and second dosing bags and remaining at the binding area with the first and second dosing bags being removed.

20. The medication packaging assembly of claim 19, wherein the first dosing bag further includes a seal provided at the open top to close the recess when the first specific medication dose is stored therein.

21. The medication packaging assembly of claim 19, wherein the plurality of packets are each organized among the plurality of dosing bag assemblies in accordance with a dosing regimen.

22. A medication packaging assembly for individual dosing comprising:

a plurality of packets each configured to store at least one medication;

a first dosing bag configured to hold a first packet of the plurality of packets, and the first dosing bag being further configured to store a first specific medication dose defined by the first packet of the plurality of packets;

a second dosing bag configured to hold a second packet of the plurality of packets, and the second dosing bag being further configured to store a second specific medication dose defined by the second packet of the plurality of packets; and a plurality of dosing bag assemblies each configured to store at least one of the first dosing bag and the second dosing bag joined at a dosing bag separation border, the plurality of dosing bag assemblies being sequentially connected together at a binding area to form a package, wherein the binding area includes a stub for each of the first dosing bag and the second dosing bag with the stub being connected to the respective one of the first dosing bag and the second dosing bag at the dosing bag separation border to provide a selectable separation location for the first and second dosing bags from the stubs at the binding area, the stubs including indicia related to the first and second dosing bags and remaining at the binding area with the first and second dosing bags being removed, wherein the plurality of packets are each organized among the plurality of dosing bag assemblies in accordance with a dosing regimen.

23. The medication packaging assembly of claim 21, wherein the first specific medication dose is of a same type of medication as the second specific medication dose, and the first specific medication dose is of a different dosage amount than the second specific medication dose.

24. The medication packaging assembly of claim 21, wherein the dosing bag separation border includes a plurality of perforations.

* * * * *